United States Patent [19]

Howland

[11] Patent Number: 4,720,980

[45] Date of Patent: Jan. 26, 1988

[54] METHOD OF OPERATING A TRANSPORT REFRIGERATION SYSTEM

[75] Inventor: Leland L. Howland, Belle Plaine, Minn.

[73] Assignee: Thermo King Corporation, Minneapolis, Minn.

[21] Appl. No.: 21,851

[22] Filed: Mar. 4, 1987

[51] Int. Cl.[4] ..... F25B 41/00; F25B 1/10

[52] U.S. Cl. ..... 62/81; 62/278; 62/503; 62/236; 62/510

[58] Field of Search ..... 62/236, 278, 503, 81, 62/80, 510, 275

[56] References Cited

U.S. PATENT DOCUMENTS

| | | | |
|---|---|---|---|
| 2,459,173 | 1/1949 | McCloy | 62/156 |
| 2,632,304 | 3/1953 | White, Jr. | 62/503 X |
| 2,637,983 | 5/1953 | Malkoff et al. | 62/278 |
| 2,709,342 | 5/1955 | Zearfoss, Jr. | 62/275 |
| 2,726,515 | 12/1955 | Kleist | 62/503 X |
| 3,012,415 | 12/1961 | La Porte | 62/503 X |
| 3,256,708 | 6/1966 | Redfern | 62/196 |
| 3,559,421 | 2/1971 | Nussbaum | 62/196 |
| 3,779,035 | 12/1973 | Kramer | 62/503 |
| 4,051,691 | 10/1977 | Dawkins | 62/236 |
| 4,139,356 | 2/1979 | Hattori | 62/278 |
| 4,217,765 | 8/1980 | Ecker | 62/503 |
| 4,537,047 | 8/1985 | Seshadri et al. | 62/510 |

*Primary Examiner*—Harry B. Tanner
*Attorney, Agent, or Firm*—D. R. Lackey

[57] ABSTRACT

A method of enhancing the defrost and heating cycles of a transport refrigeration system for a straight truck, which refrigeration system includes a single refrigeration circuit selectively connectible to a compressor driven by the truck engine, or to a stand-by compressor driven by a motor connected to a stand-by source of electrical potential. The enhancement is achieved by slowly but continuously storing heat in an accumulator from the truck electrical system, or from the stand-by source of electrical potential, such that liquified refrigerant introduced into the accumulator during a defrost or heating cycle is immmediately vaporized. The slow but continuous rate of heat storage accumulates the requisite heat without unduly loading the truck electrical system or the truck engine.

3 Claims, 2 Drawing Figures

DEFROST
EVAPORATOR
HEAT EXCHANGER
ACCUMULATOR
3-WAY VALVE
CONDENSER
RECEIVER
COMPRESSOR
MOTOR
BREAKER
STANDBY ELECTRICAL SOURCE
TRUCK ENGINE
TRUCK ELECTRICAL

METHOD OF OPERATING A TRANSPORT REFRIGERATION SYSTEM

BACKGROUND OF THE INVENTION

1. Field of the Invention

The invention relates in general to transport refrigeration systems, and more specifically to transport refrigeration systems for straight trucks.

2. Description of the Prior Art

Refrigeration systems for medium-sized straight trucks include a single refrigeration circuit and first and second compressors which are selectively connectable to the single refrigeration circuit. The first compressor, which is located in the truck engine compartment, is driven by the truck engine while the truck is delivering a refrigerated load. The second compresser, which is located in a condenser section of the refrigeration unit, is driven by an electrical motor and a stand-by source of electrical potential when the truck is at a terminal and the cargo space requires refrigeration. Defrost of an evaporator section of the refrigeration unit is accomplished by diverting the hot gas discharge of the operative compressor from its normal path through the condenser section, directly into the evaporator section. When the refrigeration system is switched from a normal refrigerant path which is followed during a cooling cycle, to a "defrost path", the suction and discharge pressures are relatively low and they increase very slowly, which extends defrost time. On electrical stand-by in a truck terminal, it is common to aid hot gas defrost by energizing relatively large wattage resistors which are provided in heat exchange relation with an evaporator coil to be defrosted. The truck electrical system is not adequate for energizing these resistors when the truck is away from the terminal.

Refrigeration units for straight trucks do not have a dedicated internal combustion engine such as commonly provided on tractor-trailer refrigeration units. Thus, there is no hot engine coolant from a dedicated engine which may be used to enhance defrost while the truck is away from a terminal.

SUMMARY OF THE INVENTION

Briefly, the present invention is a new and improved method of enhancing the defrost cycle of a truck refrigeration system of the type which lacks a dedicated prime mover of the internal combustion type. The new and improved method enhances the defrost cycle, ie., it shortens it, both at a terminal and on the road, while eliminating the need for providing and energizing large wattage resistors, and without unduly loading the truck engine or the truck electrical system.

More specifically, the new and improved method includes the steps of providing an accumulator in the suction line between the evaporator section and the suction port of the operative compressor, providing heat storage means in heat exchange relation with the accumulator, providing a low wattage resistor, eg., 50 watts, for generating and storing heat in the heat storage means, connecting the low wattage resistor to the truck electrical system when the engine driven compressor is operative, and connecting the low wattage resistor to a stand-by electrical system when a stand-by source of electrical energy is driving the motor which operates the stand-by compressor. The liquified refrigerant leaving the evaporator section during a defrost cycle is thus quickly vaporized by the stored heat in the accumulator, greatly enhancing the defrost cycle. The electrical resistor is selected to have the lowest wattage which will accumulate the necessary heat between the spaced defrost cycles to vaporize the liquified refrigerant during a defrost cycle, in order to avoid adversely affecting the truck electrical system.

BRIEF DESCRIPTION OF THE DRAWINGS

The invention may be better understood, and further advantages and uses thereof more readily apparent, when considered in view of the following detailed description of exemplary embodiments, taken with with accompanying drawings, in which.

DESCRIPTION OF PREFERRED EMBODIMENTS

Figures 1, 2:
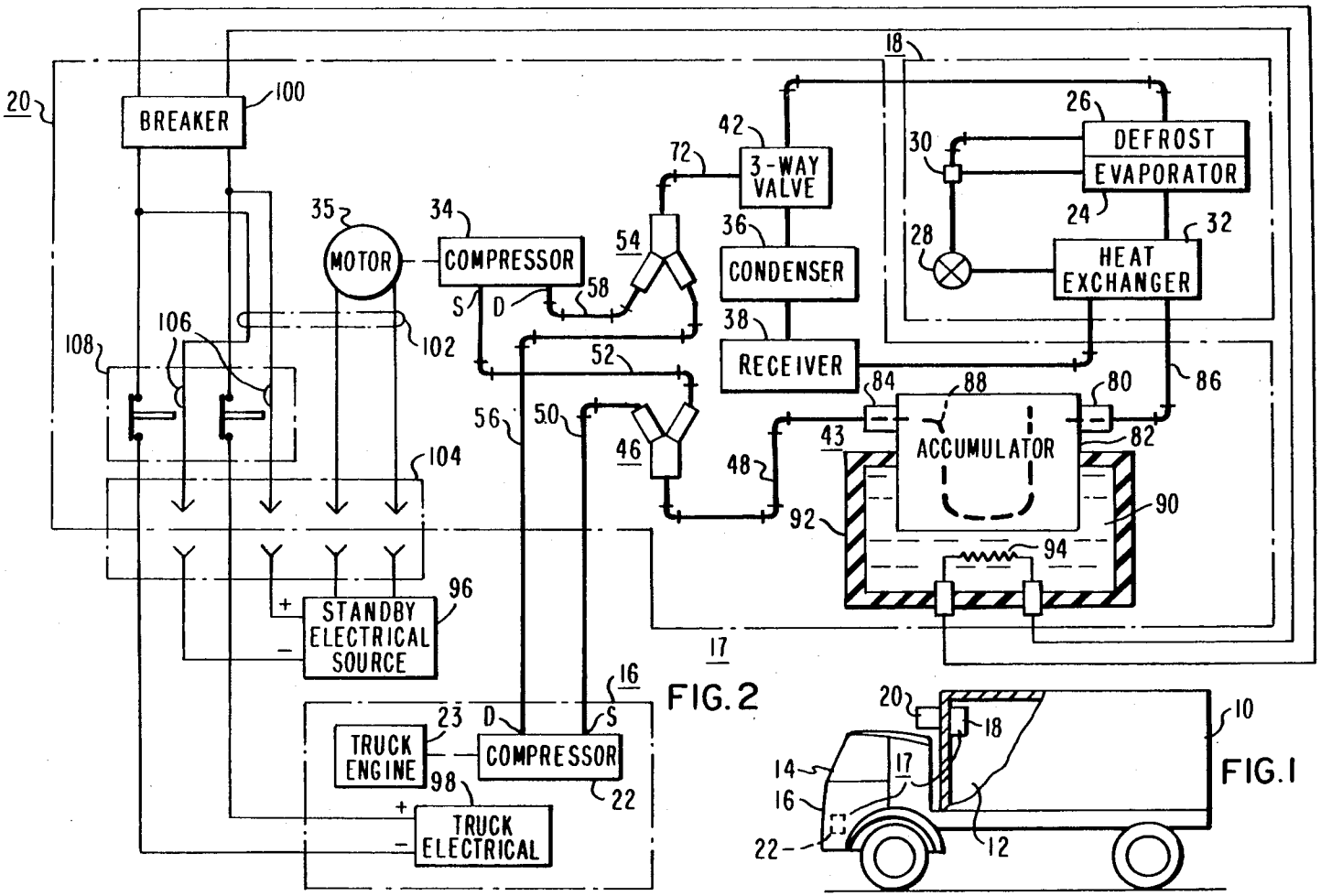
FIG. 1 is a side elevational view of a straight truck having a transport refirgeration system which may benefit from the teachings of the invention.
FIG. 2 is a diagrammatic view of a transport refrigeration system which may be operated according to the teachings of the invention.

U.S. Pat. No. 4,537,047, which is assigned to the same assignee as the present application, describes in detail a transport refrigeration system for a straight truck which may be modified to operate according to the teachings of the invention. U.S. Pat. No. 4,537,047 is hereby incorporated into the specification of the present application by reference. Components in FIGS. 1 and 2 of the present application which may be the same as in FIGS. 1 and 2 of the incorporated patent are given the same reference numerals to facilitate understanding, should more details of the refrigeration system by desired by referring to the incorporated patent.

Referring now to FIG. 1, there is shown a typical straight truck 10 which includes a load or cargo space 12 to be refrigerated, and a cab 14 having an engine compartment 16. A transport refrigeration unit 17 for refrigerating the cargo space 12 includes a single refrigeration circuit having three physically separated sections, including an evaporator section 18 located in the cargo space 12, a condenser section 20 mounted on the front wall of the cargo space 12, and an engine driven compressor 22 located in the engine compartment 16. A truck engine 23 for driving compressor 22 is illustrated in the diagrammatic representation of refrigeration system 17 shown in FIG. 2.

Referring now to FIG. 2, the evaporator section 18 includes an evaporator coil 24, a defrost tube 26, an expansion valve 28, a refrigerant distributor 30, and a heat exchanger 32. The condenser section 20 includes a stand-by compressor 34 connected to be driven by an electrical motor 35, a condenser coil 36, a refrigerant receiver 38, valve means, such as three-way valve 42, for shifting from cooling to defrost, and from cooling to heating if the refrigeration system is so arranged, and an accumulator 43. The condenser section 20 further includes first and second fittings 46 and 54 which include check valves for operatively connecting the active compressor to the single refrigeration circuit without forcing refrigerant into the suction and discharge lines of the inactive compressor.

The accumulator 43 includes an inlet 80 which introduces refrigerant into the main body or shell 82 of the accumulator, and an outlet 84. Inlet 80 receives refrigerant, which may include liquified refrigerant, especially during defrost, from the evaporator 24 via heat exchanger 32 and suction line 86. Outlet 84 directs vaporized refrigerant from the upper portion of shell 82, such as by using a U-shaped tube 88 within shell 82, to the suction port of the operative compressor via suction line 48, fitting 46 and either suction line 50 or 52.

Accumulator 43 further includes heat storage means 90 disposed in heat exchange relation with the refrigerant disposed in the accumulator shell 82 such as by disposing the heat storage means 90 in intimate contact with the outside surface of shell 82, as illustrated, or by disposing it inside of shell 82, as desired. If disposed outside of shell 82, the heat storage means 90 is enclosed within a heat insulative casing 92 to retain the heat stored in the heat storage means 90. The heat storage means 90 may be ethylene glycol, for example, or any other suitable heat storage medium.

Heat is slowly but continuously stored in heat storage means 90 via a low wattage electrical resistor or resistive element 94. The power rating of resistive element 94 is selected to be the lowest rating which will store adequate heat in heat storage means 90 between the normal defrost cycles to vaporize the liquified refrigerant introduced into accumulator 43 a during defrost cycle. For example, a resistive element rated about 50 watts is suitable for most applications.

Resistive element 94 is continuously energized as long as cargo space 12 requires refrigeration, regardless of whether truck 10 is on the road or parked at a terminal. When truck 10 is away from a terminal and thus away from a standby source of electrical potential, such as stand-by source 96, resistive element 94 is connected to the electrical system of truck 10, such as truck electrical system 98 illustrated in FIG. 2. When refrigeration system 17 is activated, a breaker 100 is automatically energized to connect resistive element 94 to a source of electrical potential. When motor 35 is not connected to stand-by source 96, then the source of electrical potential which is connected to element 94 is automatically the truck electrical system 98. When motor 35 is plugged into stand-by source 96, element 94 is also connected to a suitable output of stand-by source 96, which output has at least the same voltage level as the truck electrical system. The connection of element 94 to the truck electrical system 98 is automatically broken as the connection to stand-by source 96 is made. For example, as shown in FIG. 2, a cable 102 which connects motor 35 with source 96 via a plug-in arrangement 104 may also have conductors which connect element 94 to source 96. Plug-in arrangement 104, for example, may include means, such as cams 106, for actuating a spring-biased switch to an open position, such as indicated generally by switch contacts 108. When plug-in arrangement 104 is disengaged, switch contacts 108 are biased to the closed position, to again connect element 94 to truck electrical system 98.

Element 94 may be rated to withstand a higher voltage than the truck electrical system 98 if it is desired to increase the heat delivered to the heat storage means 90 while the stand-by source 96 is connected to the resistive element.

In summary, there has been disclosed a new and improved method of enhancing the defrost cycle of a transport refrigeration system for a straight truck, and also the heating cycle when the transport refrigeration system is arranged to maintain a set point by both heating and cooling cycles, without unduly loading the electrical system of the associated truck, or the truck engine. A relatively small wattage resistor continuously stores heat in a heat storage medium which is in heat exchange relation with an accumulator, building up an adequate reservoir of heat during a cooling cycle to cause liquified refrigerant delivered to the accumulator during a defrost cycle to be quickly vaporized, maintaining an adequate flow of hot refrigerant through the evaporator coils during defrost to more quickly perform the defrost function.

I claim as my invention:

1. A method of enhancing the defrost cycle of a truck refrigeration system which lacks a dedicated prime mover of the internal combustion type, comprising the steps of:

providing a transport refrigeration system having a first compressor operatively coupled to the engine of the associated truck, a second compressor operatively coupled to an electric motor, and a single refrigeration circuit including a condenser, evaporator, accumulator, and valve means operable to provide cooling and defrost cycles utilizing the discharge gas of one of the compressors, using the discharge gas of the first compressor in the single refrigeration circuit when the truck engine is operating, connecting the electric motor to an electrical standby source when the truck engine is not operating, using the discharge gas of the second compressor in the single refrigeration circuit when the electrical motor is connected to the electrical stand-by source, providing heat storage means in heat exchange relation with the accumulator, and providing electrical resistance means for continuously storing heat in the heat storage means while the single refrigeration circuit is connected to either one of the first and second compressors, at the lowest heat storage rate which will provide adequate heat build up between defrost cycles to vaporize liquified refrigerant introduced into the accumulator during a defrost cycle, said step of providing electrical resistance means including the steps of:

connecting the electrical resistance means to the electrical system of the associated truck when the first compressor is operative, and connecting the electrical resistance means to an electrical stand-by source when the second compressor is operative.

2. The method of claim 1 wherein the step of connecting the electrical resistance means to an electrical stand-by source when the second compressor is operative occurs simultaneously with the step of connecting the electrical motor to an electrical stand-by source when the truck engine is not operating.

3. The method of claim 1 wherein the step of connecting the electrical resistance means to an electrical stand-by source when the second compressor is operative includes the step of disconnecting the electrical resistance means from the electrical system of the associated truck.

* * * * *